US008770932B2

(12) United States Patent
Lee

(10) Patent No.: US 8,770,932 B2
(45) Date of Patent: Jul. 8, 2014

(54) FAN ASSEMBLY INCLUDING RIGID BARS WITH MOUNTING PADS

(75) Inventor: Chia-Chen Lee, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 787 days.

(21) Appl. No.: 12/967,064

(22) Filed: Dec. 14, 2010

(65) Prior Publication Data

US 2012/0128464 A1 May 24, 2012

(30) Foreign Application Priority Data

Nov. 18, 2010 (TW) ..... 99139647

(51) Int. Cl.
*F04D 19/02* (2006.01)

(52) U.S. Cl.
USPC ..... 415/213.1; 415/214.1; 416/128

(58) Field of Classification Search
USPC ..... 361/687, 690, 694, 695, 696; 415/213.1, 214.1; 416/128
See application file for complete search history.

(56) References Cited

U.S. PATENT DOCUMENTS

| | | | | |
|---|---|---|---|---|
| 6,343,014 | B1 * | 1/2002 | Lin | 361/697 |
| 7,156,611 | B2 * | 1/2007 | Oosawa et al. | 415/68 |
| 7,168,912 | B2 * | 1/2007 | Sun | 415/66 |
| 7,357,708 | B2 * | 4/2008 | Lee | 454/184 |
| 7,525,800 | B1 * | 4/2009 | Cheng | 361/695 |
| 7,537,429 | B2 * | 5/2009 | Xia et al. | 415/119 |
| 7,641,441 | B2 * | 1/2010 | Chuang | 415/118 |
| 7,909,568 | B2 * | 3/2011 | Ishihara et al. | 415/61 |
| 7,946,805 | B2 * | 5/2011 | Yoshida et al. | 415/66 |
| 8,007,234 | B2 * | 8/2011 | Yoshida | 415/222 |
| 8,172,501 | B2 * | 5/2012 | Nishizawa et al. | 415/68 |
| 2009/0046422 | A1 * | 2/2009 | Lu | 361/690 |
| 2012/0121406 | A1 * | 5/2012 | Wu et al. | 415/213.1 |
| 2012/0128464 | A1 * | 5/2012 | Lee | 415/66 |

* cited by examiner

*Primary Examiner* — Edward Look
*Assistant Examiner* — Christopher R Legendre
(74) *Attorney, Agent, or Firm* — Novak Druce Connolly Bove + Quigg LLP

(57) ABSTRACT

A fan assembly includes two fans, and a number of rigid bars. The fans are connected in series. Each of the fans includes an impeller. The impellers of the fans rotate in opposite directions. The rigid bars extend through the fans and are fixed to the fans, to counteract opposing torque forces produced by the fans.

7 Claims, 3 Drawing Sheets

FAN ASSEMBLY INCLUDING RIGID BARS WITH MOUNTING PADS

BACKGROUND

1. Technical Field

The present disclosure relates to a fan assembly.

2. Description of Related Art

Generally, in an electronic device, such as a server, two fans rotating in opposite directions are connected in series, to increase air pressure and heat dissipating efficiency. However, more vibrations are produced when such fans are connected in series.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
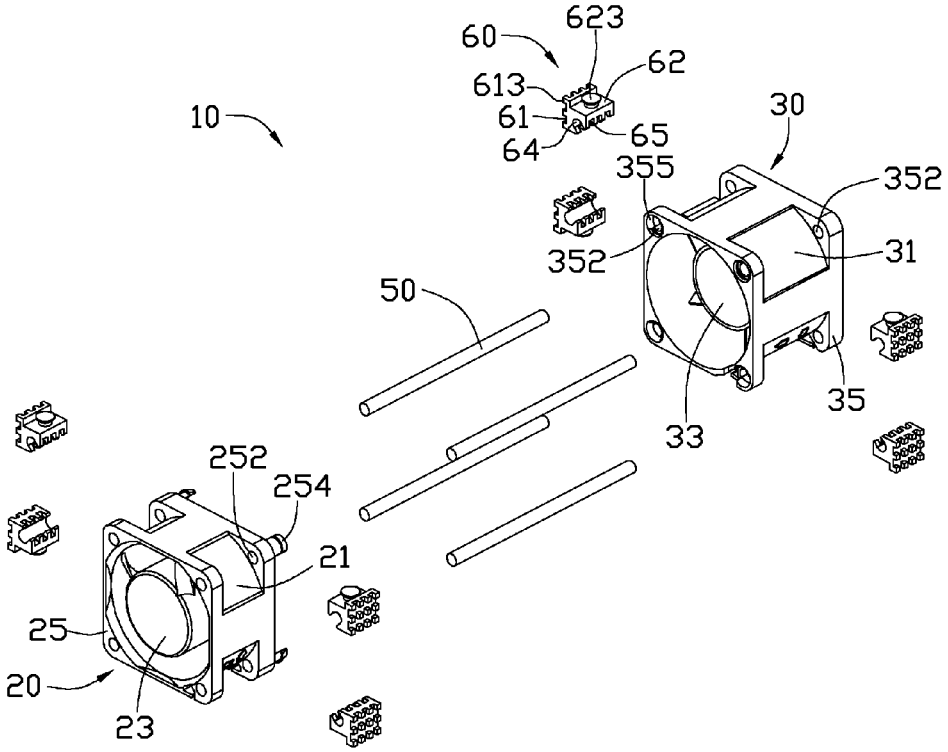
FIG. 1 is an exploded, isometric view of an embodiment of a fan assembly.

Referring to FIG. 1, an embodiment of a fan assembly 10 includes a first fan 20, a second fan 30, four rigid bars 50, and eight resilient pads 60.

The first fan 20 includes a cylinder-shaped main body 21, and two quadrate plates 25 respectively extending from opposite ends of the main body 21. An impeller 23 is installed in the main body 21. Four through holes 252 are respectively defined in four corners of each plate 25. Four hooks 254 extend outward from one of the plates 25 adjacent to the through holes 252 of the plate 25, respectively.

The second fan 30 includes a cylinder-shaped main body 31, and two quadrate plates 35 respectively extending from opposite ends of the main body 31. An impeller 33 is installed in the main body 31. Four through holes 352 are defined in each plate 35 adjacent to four corners of the plate 35, respectively. Four hook slots 355 are defined in one of the plates 35 adjoining the through holes 352 of the plate 35, respectively.

Each resilient pad 60 is substantially cube-shaped, and made of rubber or rubber-like material. A plurality of protrusions 613 is formed on a first side 61 of the resilient pad 60. A fixing portion 623 protrudes from a second side 62 of the resilient pad 60 connected to the first side 61. A recess 64 having a C-shaped cross-section is defined in an edge of the resilient pad 60 opposite to the first and second sides 61 and 62, with opposite ends of the recess 64 extending through opposite ends of the resilient pad 60. A plurality of slots 65 communicating with the recess 64 is defined in two portions of the resilient pad 60 bounding opposite sides of the recess 64, to increase the elastic coefficient of the resilient pad 60.

Figure 2:
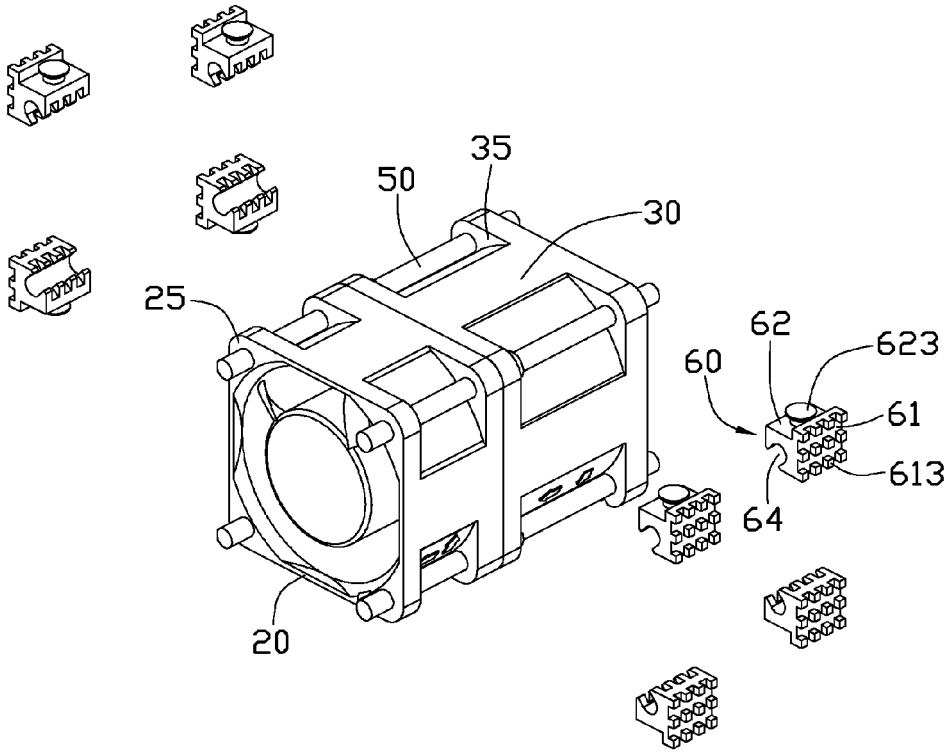
FIG. 2 is a partially assembled, isometric view of FIG. 1.
Figure 3:
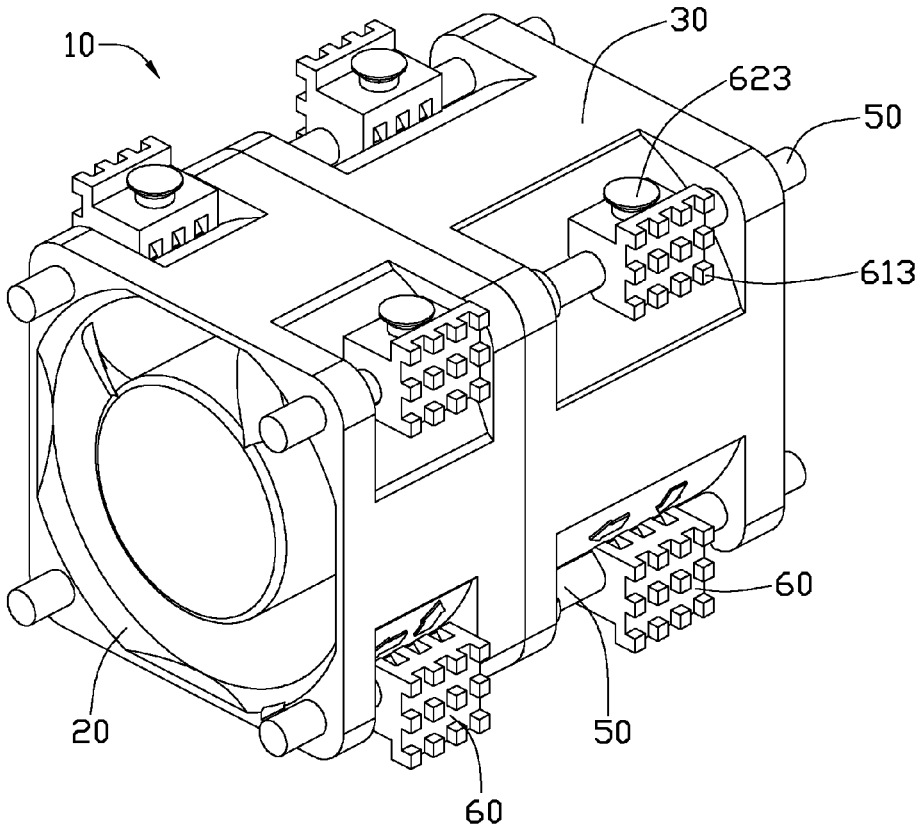
FIG. 3 is an assembled, isometric view of FIG. 1.

Referring to FIGS. 2 and 3, in assembly, the hooks 254 of the first fan 20 are engaged in the corresponding hook slots

355 of the second fan 30. Thereby, the first fan 20 and the second fan 30 are connected in series. Air is blown in the same direction by the first and second fans 20 and 30, but rotating directions of the impellers 23 and 33 are opposite. The through holes 252 of the plates 25 of the first fan 20 align with the through holes 352 of the plates 35 of the second fan 30, respectively. The rigid bars 50 are respectively inserted into the corresponding through holes 252 and 352 of the first and second fans 20 and 30, and fixed to the first and second fans 20 and 30. A resilient pad 60 is placed around a section of each rigid bar 50 between the plates 25 of the first fan 20, and another resilient pad 60 is placed around a section of each rigid bar 50 between the plates 35 of the first fan 30, with the recess 64 of each resilient pad 60 engaging with the corresponding rigid bar 50. The first and second sides 61 and 62 of each resilient pad 60 are exposed outwards. The fan assembly 10 can be mounted to a fixing apparatus (not shown) using the fixing portions 623.

In use, the impellers 23 and 33 of the first and second fans 20 and 30 rotate in opposite directions, and produce opposing torque forces. The rigid bars 50 connect four corners of the first and second fans 20 and 30, and can reduce vibrations by counteracting the opposing torque forces produced by the first and second fans 20 and 30 through the high force transitivity of the rigid bars 50. Furthermore, the resilient pads 60 installed to the rigid bars 50 can absorb vibrations.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fan assembly comprising:

two fans connected in series, each of the fans comprising an impeller, the impellers of the fans operable to rotate in opposite directions; and a plurality of rigid bars extending through the fans and fixed to the fans, wherein each of the fans comprises two opposing quadrate plates, four through holes are respectively defined in four corners of each of the plates, the plurality of rigid bars comprises four rigid bars, said four rigid bars respectively extend through the through holes of the fans and are fixed to the four corners of the fans, and each of the fans further comprises a cylinder-shaped main body arranged between the corresponding plates, for receiving the corresponding impeller; and, wherein a resilient pad is installed to a section of each of the rigid bars between the corresponding plates of each of the fans.

2. The fan assembly of claim 1, wherein each resilient pad is substantially cube-shaped, a recess having a C-shaped cross-section is defined in an edge of each resilient pad, to engage with a corresponding rigid bar.

3. The fan assembly of claim 2, wherein each resilient pad is made of rubber material.

4. The fan assembly of claim 2, wherein a plurality of protrusions is formed on a side of each resilient pad opposite to the corresponding recess.

5. The fan assembly of claim 2, wherein a plurality of slots is defined in two portions of each resilient pad bounding opposite sides of the corresponding recess.

6. The fan assembly of claim 1, wherein the fans are connected to each other by hooks and hook slots.

7. The fan assembly of claim 1, wherein air is blown in the same direction by the fans.

* * * * *